United States Patent [19]

Miller

[11] Patent Number: 4,792,051

[45] Date of Patent: Dec. 20, 1988

[54] REVERSIBLE SHELF DIVIDER

[75] Inventor: Byron R. Miller, Springboro, Ohio

[73] Assignee: The Mead Corporation, Dayton, Ohio

[21] Appl. No.: 154,700

[22] Filed: Feb. 11, 1988

[51] Int. Cl.[4] ..... A47F 5/00

[52] U.S. Cl. ..... 211/184; 108/61; 211/59.2; 211/DIG. 1

[58] Field of Search ..... 211/59.2, 184, 43, DIG. 1; 248/206.5; 108/60, 61

[56] References Cited

U.S. PATENT DOCUMENTS

| | | | |
|---|---|---|---|
| 2,538,908 | 1/1951 | McKeehan | 211/184 |
| 2,658,628 | 11/1953 | Hilgen | 211/184 |
| 2,884,139 | 4/1959 | Dunham | 211/184 |
| 3,974,918 | 8/1976 | Yaremchuk | 211/184 X |
| 4,051,789 | 10/1977 | Howitt | 108/152 |
| 4,183,438 | 1/1980 | Huczek | 211/184 X |
| 4,331,243 | 5/1982 | Doll | 211/59.2 |
| 4,488,653 | 12/1984 | Belokin | 211/184 |
| 4,618,063 | 10/1986 | Mendenhall | 211/184 |

*Primary Examiner*—Robert W. Gibson, Jr.
*Attorney, Agent, or Firm*—Biebel, French & Nauman

[57] ABSTRACT

A reversible shelf divider particularly advantageous for use on shelving systems having sloping shelves comprises a divider member having a length edge of a first dimension and a width edge of a second dimension which is lesser than the first dimension. A first combination slide/stop member is connected to the length edge of the divider member and extends at right angles thereto. The first combination slide/stop member extends the full length of the divider member and projects equally on each of its sides. A second combination slide/stop member is connected to the width edge of the divider member and extends at right angles thereto. The second combination slide/stop member extends the full width of the divider member and projects equally on each of its sides. Equally dimensioned and symetrically placed slots are formed on the first and second slide/-stop members for receiving fasteners which secure either the first or the second slide/stop member to a shelf to thereby permit the selection of alternate stop member heights in shelving systems incorporating the dividers.

7 Claims, 3 Drawing Sheets

REVERSIBLE SHELF DIVIDER

BACKGROUND OF THE INVENTION

The present invention relates generally to shelving systems having one or more sloping shelves, and more particularly, to a reversible shelf divider which is particularly advantageous for use on sloping shelves whereby each divider can selectively provide two alternate package stop heights.

Shelving systems having sloping shelves are commonly used for displaying magazines, newspapers, notebook paper and similar type products. While sloping shelves facilitate display of these products, due to the slope of the shelves, stop members must be provided at or near the forward edges of the shelves such that the items being displayed do not slide off the shelves. To this end, a shelf divider is disclosed in U.S. Pat. No. 4,183,438 and comprises a divider member positioned of a sliding member and terminated by a stop member. Pins are inserted into, formed to extend from, or clipped to the shelf divider for insertion into a series of holes formed along the forward edge of the sloping shelves to retain the divider on the shelves.

While the shelf divider of the cited patent is effective in providing a stop member required for retaining items on sloping shelves, each shelf divider provides a single height stop member such that different sizes of dividers are required to define different stop member heights. Accordingly, the prior art shelf dividers can produce inventory problems where different stop heights are required, and can restrict the ability of users of sloping shelves to prepare and vary from time-to-time the layout of products displayed upon the shelves.

It is thus apparent that the need exists for a more versatile shelf divider for shelving units including sloping shelves which will provide alternate stop member heights to expedite and facilite display layouts, and also reduce by a factor of two production and inventory expenses related to such shelf dividers.

SUMMARY OF THE INVENTION

The improvement in shelving display apparatus in accordance with the present invention comprises a reversible shelf divider particularly advantageous for use on shelving systems having sloping shelves. The reversible shelf divider permits the selection of alternate stop member heights in addition to versatile positioning of the dividers on the shelves.

Such a reversible shelf divider comprises a divider member having a length edge of a first dimension and a width edge of a second dimension which is less than the first dimension. A first combination slide/stop member is connected to the length edge of the divider member and extends at right angles thereto. The first combination slide/stop member extends the full length of the divider member and projects therefrom on both sides. A second combination slide/stop member is connected to the width edge of the divider member and extends at right angles thereto. The second combination slide/stop member extends the full width of the divider member and projects therefrom on both sides. Aperture means are formed into the first and second combination slide/-stop members for receiving fastener means to secure either the first or the second combination slide/stop member to a shelf. Accordingly, the reversible shelf divider can present a stop height of either the first dimension corresponding to the length edge of the divider member, or of the second dimension corresponding to the lesser dimension of the width edge of the divider member.

Preferably, the aperture means comprise slots running parallel to the divider member which slots are sized to accommodate a variety of hole pattern sizes formed on shelves which can receive the shelf divider. The appearance of a shelving unit incorporating reversible shelf dividers in accordance with the present invention is enhanced if the divider member forms a right triangle having its hypotenuse extending between the centers of the distal ends of the first and second combination slide/stop members. Shelving unit layout can be further expedited by securing magnetic means to the first and second combination slide/stop members for initial positioning of a divider on a metal shelf.

It is a primary object of the present invention to provide a shelf divider which can be conveniently secured to a sloping shelf in one of two reversible orientations to provide one of two differing height stop members for a shelving unit incorporating the shelf divider.

Other objects and advantages of the invention will be apparent from the following description, the accompanying drawings and the appended claims.

DETAILED DESCRIPTION OF THE INVENTION

Figure 1:
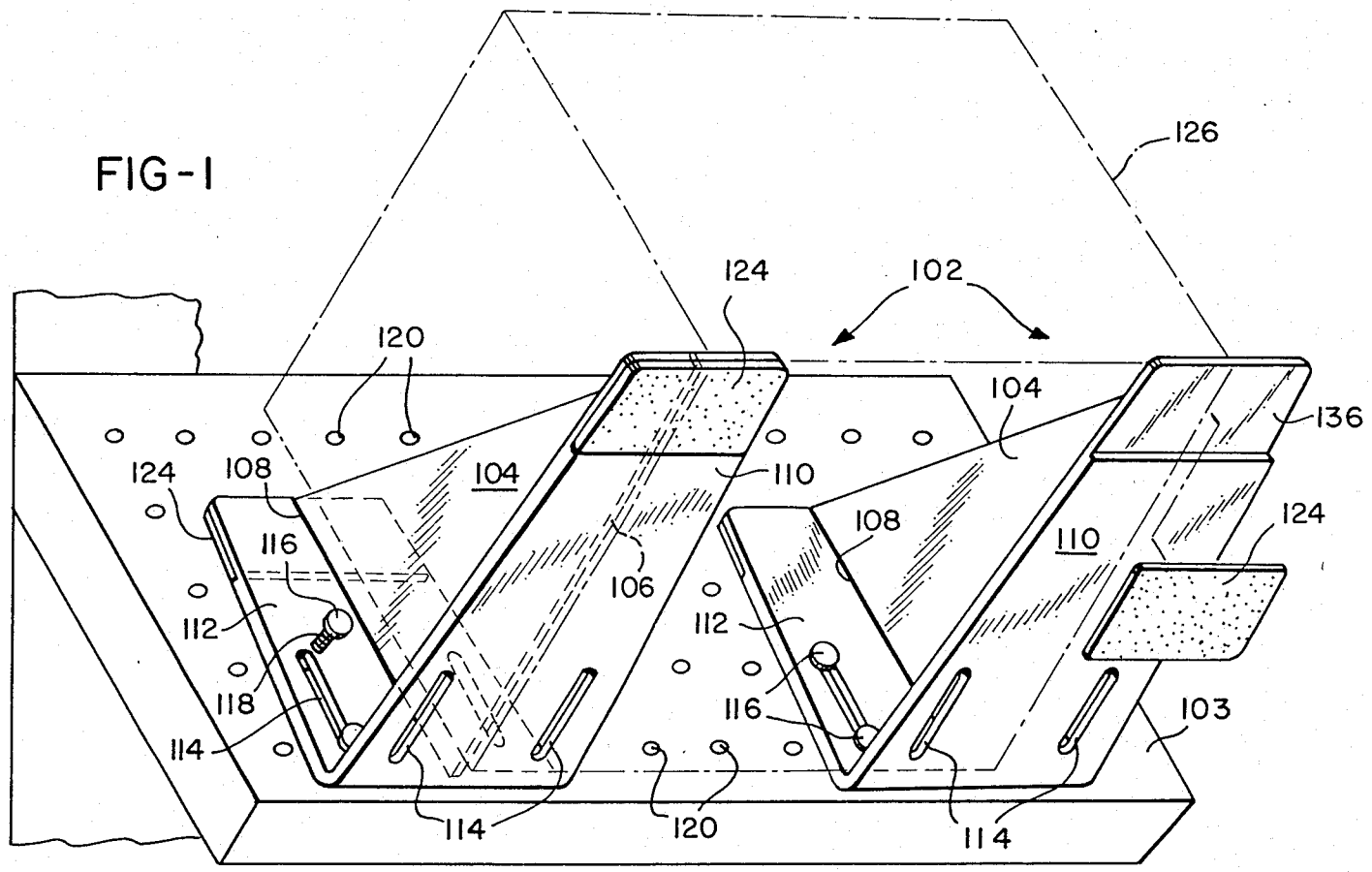
FIGS. 1 and 2 are perspective views of sloping shelves including reversible shelf dividers in accordance with the present invention oriented to present high package stop members in Fi and low,,package stop members in FIG. 2.
Figure 2:
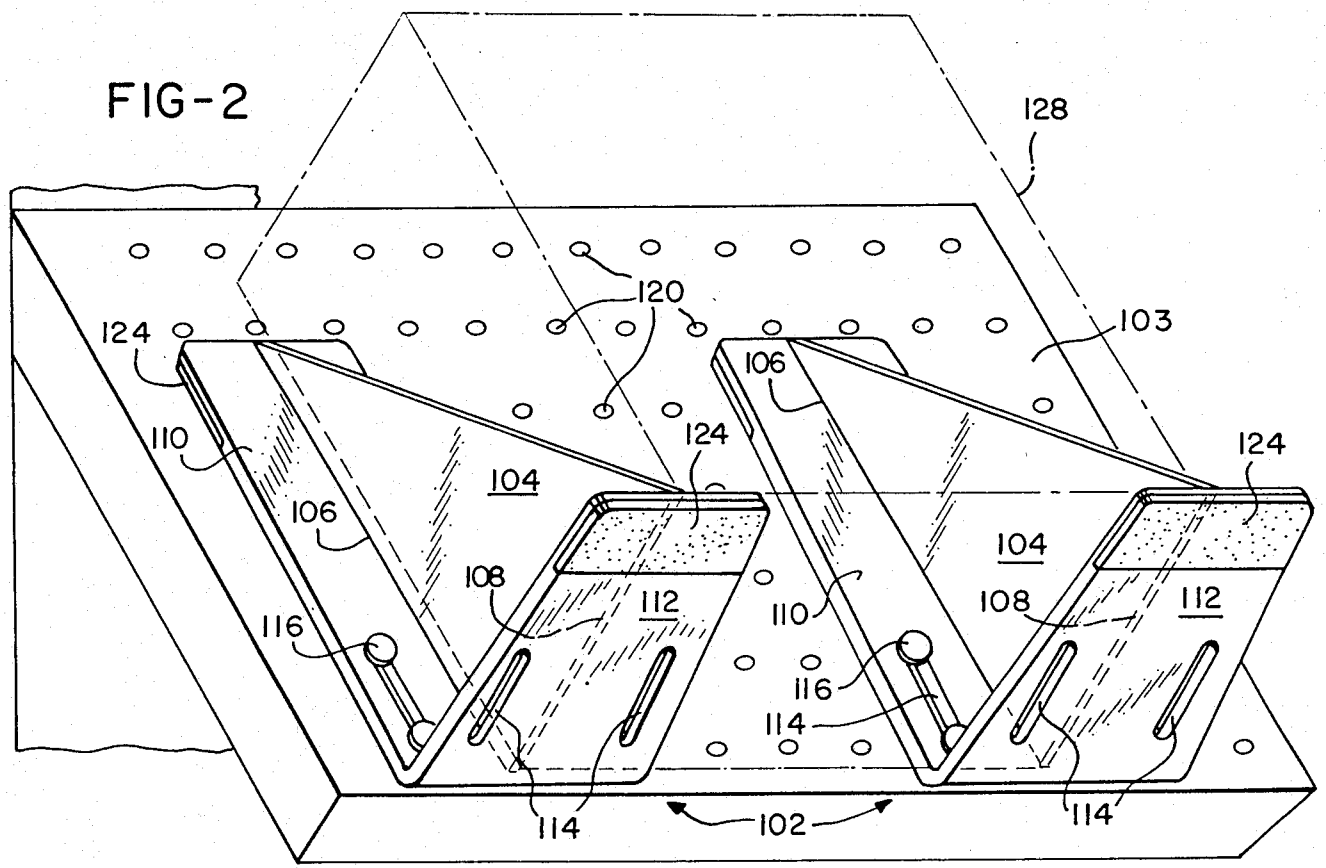
Figure 5:
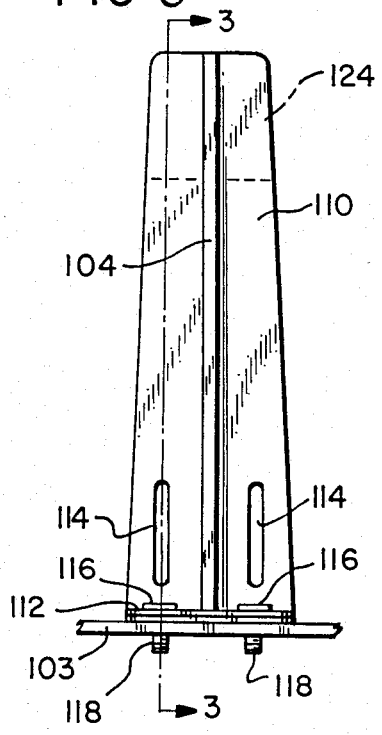
FIGS. 3, 4 and 5 show a sectional front view, top and side views, respectively, of a reversible shelf divider in accordance with the present invention.
Figure 4:
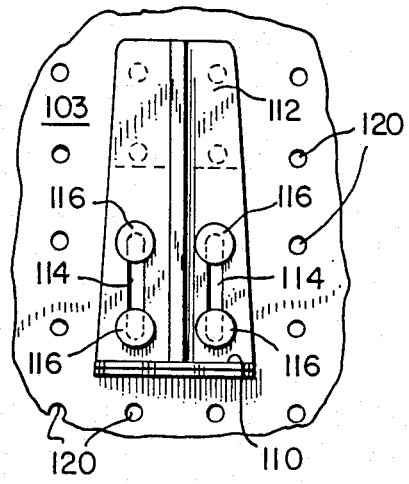
Figure 3:
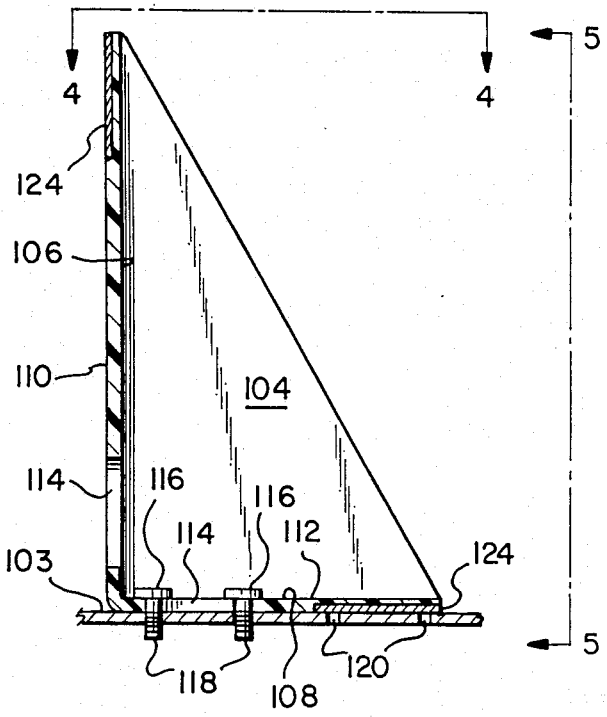

FIGS. 1 and 2 each show a pair of reversible shelf dividers 102 formed in accordance with the present invention secured to sloping shelves 103. Reference should also be made to FIGS. 3–5 which clarify details of the dividers 102. Each of the reversible shelf dividers 102 comprises a divider member 104 having a length edge 106 of a first dimension and a width edge 108 of a second dimension which is less than the first dimension. Representative width and length dimensions for reversible shelf dividers made in accordance with the present invention include 4″×6″ and 5″×8″. Of course, any convenient width and length dimensions can be provided for a given application.

A first combination slide/stop member 110 is connected to the length edge 106 and extends at right angles thereto. The first combination slide/stop member 110 extends the full length of the divider member 104 and projects equally on each side of the divider member 104.

A second combination slide/stop member 112 is connected to the width edge 108 of the divider member 104 and extends al right angles thereto. The second combination slide/stop member 112 extends the full width of the divider member 104 and projects equally on each side of the divider member 104. The illustrated embodiments of the reversible shelf dividers 102 in accordance with the present invention have the first and second combination slide/stop members 110, 112 tapered toward the distal ends thereof to enhance the appearance of the dividers and to facilitate removal of products retained on the sloping shelves 103 by the dividers 102.

Aperture means, preferably comprising slots 114, are formed into the first and second combination slide/stop members 110, 112 for receiving fastener means to secure either the first or the second combination slide/stop member 110 or 112 to a shelf. In this way, the reversible shelf divider 102 can present a stop height of either a first dimension corresponding to the length edge 106 of the divider member 104, or a second dimension corresponding to the width edge 108 of the divider member 104.

The fastener means preferably comprise flat headed connectors 116 made of a synthetic material, such as polyethylene or nylon, and include roughened or threaded extensions 118 sized to frictionally engage holes 120 formed in regular patterns on the shelves 103. As best shown in FIGS. 1, 2 and 3, the preferred form of the divider member 104 is a right triangle having its hypotenuse extending between the centers of the distal ends of the first and second combination slide/stop members 110, 112.

To facilitate setup of shelving units incorporating the reversible shelf dividers 102, magnetic means comprising thin sheets 124 of magnetic material may be secured to the first and second combination slide/stop members 110, 112. It should be apparent that such magnetic means temporarily maintain the dividers 102 in position on metal shelves prior to securing the shelf dividers 102 to the shelves with the connectors 116. Sheets 124 are preferably bonded into recesses 136 (one such recess being illustrated in FIG. 1) formed in the outer surfaces of slide/stop members 110, 112.

The reversible shelf dividers 102 in accordance with the present invention can be oriented to present a package stop member of a first dimension, as shown in FIG. 1, by securing the second combination slide/stop member 112 to the shelf 103 such that the first combination slide/stop member 110 extends outwardly from the shelf 103. In this orientation, the shelf dividers 102 support packages up to a height as indicated by the phantom line box 126, and possibly there beyond provided the lower edge of the uppermost package engages the package stop members 110 of the dividers 102. Alternately, the shelf dividers 102 can be reversed or reoriented to present a package stop member of a second dimension, as shown in FIG. 2, by securing the first combination slide/stop member 110 to the shelf 103 such that the second combination slide/stop member 112 extends outwardly from the shelf 103. In this orientation, the shelf dividers 102 support packages up to an alternate height as indicated by the phantom line box 128, and possibly therebeyond provided the lower edge of the uppermost package engages the package stop members 112 of the dividers 102.

It is, thus, apparent that the reversible shelf dividers in accordance with the present invention which are particularly applicable for shelving units including one or more sloping shelves, each provide two alternate stop member heights to increase their versatility and expedite and facilitate layouts of displays incorporating the reversible shelf dividers. While symmetrically positioned slots 114 comprise the preferred aperture means for receiving fasteners to secure the reversible shelf dividers 102 to the shelves 103, it should be apparent that alternate openings could be formed into the first and second combination slide/stop members 110, 112 to accommodate various applications of the present invention.

Accordingly, while the form of apparatus herein described constitutes a preferred embodiment of this invention, it is to be understood that the invention is not limited to this precise form of apparatus and that changes may be made therein without departing from the scope of the invention which is defined in the appended claims.

What is claimed is:

1. A reversible shelf divider comprising: a divider member having a length edge of a first dimension and a Width edge of a second lesser dimension;

a first combination slide/stop member connected to said length edge and extending at right angles thereto, said first combination slide/stop member extending the full length of said divider member and projecting on each side of said divider member;

a second combination slide/stop member connected to said width edge and extending at right angles thereto, said second combination slide/stop member extending the full width of said divider member and projecting on each side of said divider member; and aperture means formed in both projecting sides of said first and second combination slide/stop members for receiving fastener means to secure either said first or said second combination slide/stop member to a shelf whereby said reversible shelf divider can present a stop height of either said first dimension or said second dimension.

2. A reversible shelf divider as claimed in claim 1 wherein said aperture means comprise slots running parallel to said divider member and sized to accommodate a variety of hole pattern sizes formed on shelves which receive said shelf divider.

3. A reversible shelf divider as claimed in claim 2 wherein said combination slide/stop members project equally on both sides of said divider member.

4. A reversible shelf divider as claimed in claim 3 wherein said divider member forms a right triangle having its hypotenuse extending between the centers of the distal ends of said first and second combination slide/stop members.

5. A reversible shelf divider as claimed in claim 4 wherein said combination slide/stop members are tapered toward their distal ends.

6. A reversible shelf divider as claimed in claim 2 further comprising magnetic means secured to said first and second combination slide/stop members for initial positioning of said divider on a metal shelf.

7. A reversible shelf divider as claimed in claim 6 wherein said slide/stop members are provided with recesses on their outer surfaces and said magnetic means comprise sheets of magnetic material bonded into said recesses.

* * * * *